US006795986B2

(12) United States Patent
Marbach et al.

(10) Patent No.: US 6,795,986 B2
(45) Date of Patent: Sep. 28, 2004

(54) ABOVE-GROUND SWIMMING POOL WITH A RIGID STRUCTURE

(75) Inventors: Gérard Marbach, Cernay (FR); Eric Bonnin, Altkirch (FR)

(73) Assignee: Zodiac European Pools (FR)

( * ) Notice: Subject to any disclaimer, the term of this patent is extended or adjusted under 35 U.S.C. 154(b) by 0 days.

(21) Appl. No.: 10/644,528

(22) Filed: Aug. 20, 2003

(65) Prior Publication Data

US 2004/0103472 A1 Jun. 3, 2004

(30) Foreign Application Priority Data

Aug. 21, 2002 (FR) ..... 02 10447

(51) Int. Cl.[7] ..... E04H 4/00
(52) U.S. Cl. ..... 4/506
(58) Field of Search ..... 4/506, 513, 585, 4/488; 52/169.7, 245

(56) References Cited

U.S. PATENT DOCUMENTS 3,934,277 A * 1/1976 Quirouette et al. ..... 52/245
4,062,158 A * 12/1977 Kaufmann et al. ..... 52/71
4,167,084 A * 9/1979 Brunton ..... 52/169.7
6,272,696 B1 * 8/2001 Sobel et al. ..... 4/506
6,421,846 B1 * 7/2002 Shaanan et al. ..... 4/506

FOREIGN PATENT DOCUMENTS

FR 2709144 2/1995

* cited by examiner

*Primary Examiner*—Gregory L. Huson
*Assistant Examiner*—Huyen Le
(74) *Attorney, Agent, or Firm*—Dean W. Russell; Kilpatrick Stockton LLP

(57) ABSTRACT

A swimming pool with a rigid structure, comprises a rigid peripheral wall made of a rot-resistant material supported by posts and a flexible waterproof liner arranged in the space defined by the rigid wall and attached to the upper edge of the said wall, in which, along their full height, the posts comprise an interior portion made of a rot-resistant material to which the rigid wall is secured and an externally projecting portion having at least two grooves, one on either side, and cladding panels having at least externally at least the appearance of wood are slid into the opposing grooves of two consecutive posts the externally projecting portions of the posts being of such dimensions and the grooves being so positioned that there is a gap between the cladding panels and the rigid wall.

11 Claims, 3 Drawing Sheets

ABOVE-GROUND SWIMMING POOL WITH A RIGID STRUCTURE

CROSS-REFERENCE TO RELATER APPLICATION

This application claims priority to French Patent Application No. 02 10447 filed on Aug. 21, 2002, the entire contents of which are incorporated by reference herein.

FIELD OF THE INVENTION

The present invention relates to improvements to above-ground swimming pools with a rigid structure, comprising a rigid peripheral wall made of a rot-resistant material supported by posts and a flexible waterproof liner arranged in the space defined by the rigid wall and attached to the upper edge of the said wall.

DESCRIPTION OF THE PRIOR ART

Swimming pools of this kind, intended for the general public, are generally installed in a garden in the middle of a lawn. Aesthetically, however, they are not very attractive, whatever the method of construction or materials used (metal and/or plastic).

There is therefore a demand among users for a better external finish to these swimming pools, particularly in order to integrate them more satisfactorily into the environment of the garden in which they are set up. An external finish in wood would meet this aspiration.

It is for this reason that swimming pools are available on the market that are constructed entirely of wood, with a wall formed from vertical wooden boards (staves) set side by side in a roughly circular or oval outline and held in place by external metal strapping, in a technique derived from the manufacture of barrels.

This type of swimming pool has the disadvantages inherent in its structure: erection is somewhat complex, it is impossible to produce swimming pools in anything other than circular or oval shapes, it is almost impossible to make large swimming pools, and the owner is effectively obliged to keep the water in the pool to avoid movement in the wooden boards. In addition, installing these swimming pools necessitates very meticulous preparation of the ground.

Another known type of swimming pool comprises a rigid structure of wood, in the form for example of planks or round timbers assembled with intersecting extremities, while the water is contained by using a flexible inner liner as in a conventional swimming pool: see in particular documents EP A-0 756 650; FR-A-2 785 003; FR-A-2 745 600 and FR-A-2 376 276.

The drawback with this type of swimming pool is that the wooden structure is difficult to erect, requiring skill and appropriate equipment, and it is beyond the capabilities of the average do-it-yourselfer. Moreover, moisture appearing underneath the flexible liner wets the wood and the wood can quickly become damaged: as a result, careful and regular maintenance is required.

To summarize, the abovementioned swimming pools with a wooden structure do not fulfil the requirements of the majority of users as their material is subject to rot and they are sensitive to water (humidity, condensation and contact with the ground). As a result, they have not gained wide popularity.

SUMMARY OF THE INVENTION

It is therefore an object of the invention to provide an improved structure for an above-ground swimming pool with a rigid structure that better meets the aspirations of users.

To this end, an above-ground swimming pool with a rigid structure as set out in the preamble is characterized in that along their full height, the posts comprise an interior portion made of a rot-resistant material to which the abovementioned rigid wall is secured and an externally projecting portion having at least two grooves, one on either side, and cladding panels having at least externally at least the appearance of wood are slid into the opposing grooves of two consecutive posts;

the externally projecting portions of the posts being of such dimensions and the grooves being so positioned that there is a gap between the cladding panels and the rigid wall, In a preferred embodiment, the swimming pool possesses a polygonal general form and the rigid wall is formed from rigid panels made of rot-resistant material each fixed to the respective interior portions of successive posts. In an advantageous illustrative embodiment, the rigid panels comprise lateral edges extending outwards and each rigid panel is engaged between the respective interior portions of two consecutive posts with the extending edges applied against the said interior portions of the respective posts and screwed to them, that face of the rigid panel which is towards the interior of the swimming pool being flush with the respective inward-facing faces of the posts.

In one practical illustrative embodiment, the cladding panels are made of a composite wood/polymer material having at least externally the appearance of wood. The type of material envisaged is advantageous because it is easy to machine and has good performance in the presence of humidity and water.

However, it is of course possible for the cladding panels to be made of wood, in which case the arrangement can be such that each cladding panel made of wood is constructed by stacking several wooden planks on edge.

The externally projecting portion of each post may be made of wood, in which case the post has a mixed structure with the projecting wood portion attached to that portion of the post, by which the rigid wall is supported, that is itself made of a rot-resistant material.

It is of course also conceivable for the externally projecting portion of each post to be a section made of a wood/polymer composite material.

In practice, the rigid wall and the interior portion of the posts, which are made of rot-resistant materials, are made of a plastic material, or preferably are made of metal (non-oxidizing metal such as stainless steel or galvanized steel or aluminium).

Advantageously again, the respective upper edges of the rigid wall that support the section to which the flexible liner is fastened, on the one hand, and of the wooden cladding panels on the other, are situated essentially at the same height and a coping is attached to the upper edge of the wooden cladding panels in such a way that it straddles the said edges of both the rigid wall and the cladding panels and the gap between them.

Thus, owing to the provisions of the invention, the structure made of wood or having the appearance of wood is no more than simply cladding around the conventional rigid wall of the swimming pool. This preserves the conventional rigid structure, whose qualities (strength and watertightness) are well known and proven while the wooden cladding, which is not required to exhibit specific functional qualities, can be installed relatively quickly and easily without special tools.

As a result of this, the ground on which the swimming pool is laid can be prepared (made flat and horizontal) in a simple manner, in the same way as for a conventional rigid above-ground swimming pool, without having to call in a specialist.

The relative configurations of the rigid wall and the cladding panels made of wood, with the maintenance between them of a sufficient gap (in practice of the order of 2 to 3 cm for example) even if the wall of the swimming pool is slightly deformed under the pressure of the water, ensures that the surface of the wood is aired and prevents moisture, which may develop on the back of the rigid wall, from wetting the cladding panels.

In addition, due to the design itself of the proposed structure in accordance with the invention, it is conceivable for the cladding made of wood or having the appearance of wood to be attached with no great difficulty around a pre-existing above-ground swimming pool that has already been installed.

Lastly, the provisions in accordance with the invention allow a great deal of freedom in the design and/or siting of the swimming pool. For instance, the provisions can be followed in the case of an above-ground swimming pool that is partly below ground level: in this case the rigid wall extends the full height of the pool, including the lower part which is below ground, and the cladding panels are arranged only around the above-ground part of the swimming pool, which is the only visible part.

BRIEF DESCRIPTION OF THE DRAWINGS

A clearer understanding of the invention will be gained from reading the following detailed description of certain embodiments provided as non-limiting examples. This description refers to the attached drawing, in which.

DETAILED DESCRIPTION OF THE INVENTION

Figure 1:
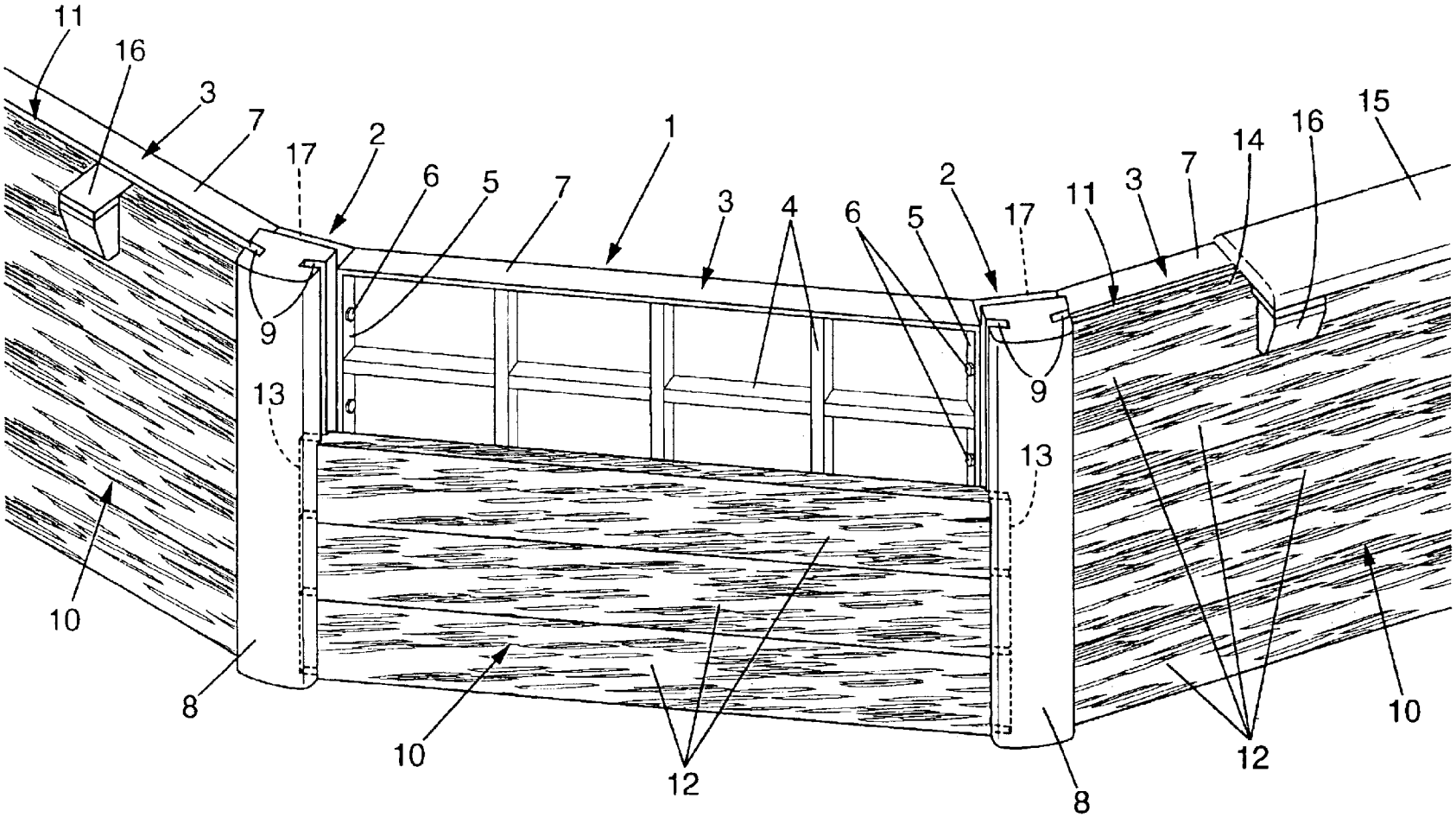
FIG. 1 is a partial perspective view, with cut-away, of a preferred embodiment of an above-ground swimming pool in accordance with the invention.

Beginning with FIG. 1, this shows only those parts of the above-ground swimming pool that are necessary for an understanding of the invention.

In FIG. 1, an above-ground swimming pool with a rigid structure comprises a rigid peripheral wall 1 supported by posts 2 and a waterproof flexible liner (not shown) arranged in the space defined by the rigid wall 1 and attached to the upper edge of this wall, in any way known to those skilled in the art.

The provisions of the invention apply with particular advantage to the case of an above-ground swimming pool of polygonal, e.g. hexagonal or octagonal, general form, or of elongate polygonal form ("oval" polygonal), in which the posts 2 are situated at the corners of the perimeter of the polygonal and the rigid wall 1 is formed from rigid panels 3 made of rot-resistant material—plastic or preferably non-oxidizing metal such as stainless steel, galvanized steel or aluminium with a structural framework 4 so that they are strong enough to withstand the pressure of the water.

Each panel 3 may comprise at least a number of lateral edges 5 extending towards the rear. Each panel 3 is then engaged between two consecutive posts 2 with its lateral edges 5 bearing against the respective posts 2 and screwed 6 to them.

The upper edge 7 of each rigid panel 3 also preferably extends towards the rear, partly to strengthen the panel and partly to act as a support, as will be indicated later.

In the proposed configuration, that face of each rigid panel 3 which is turned towards the interior of the swimming pool is approximately flush with that face of the adjacent post 2 which is turned towards the pool, so that the assembly defines a bearing surface which, although polygonal, is effectively continuous, for the flexible liner.

Turning more specifically to the posts 2, to avoid damp damage to their face against which the flexible liner rests, they are made in two parts: one part 17 on the inside is made of a rot-resistant material (plastic or preferably metal such as stainless steel or galvanized steel or aluminium) and one part on the outside is formed by an externally projecting portion 8, the latter being the only part to be made of a material having the appearance of wood at least on the outside, that is to say consisting either of wood or of a material of which at least the visible part gives the appearance of wood.

The externally projecting portion 8 of each post 2 occupies the full height and has at least two grooves 9, one on either side, which run the full height of the post.

Cladding panels 10 made of a material having at least the appearance of wood, at least externally, are slid into the opposing grooves 9 belonging to two consecutive posts 2.

The externally projecting portions 8 of the posts 2 are of such dimensions, and the grooves 9 are so situated, that the cladding panels 10 are separated from the rigid panels 3 by a gap 11. The presence of this gap 11 ensures that any moisture that may appear behind the rigid panels 3 cannot touch the cladding panels 10 and wet the material having at least the appearance of wood and also permits ventilation of the surface of the cladding panels, which will extend its life.

In an embodiment which gives the swimming pool an interesting external aesthetic appearance, each cladding panel 10 is constructed by stacking on edge several planks or boards 12, the ends of which may be cut into tenons 13 suitable for insertion into the grooves 9 forming slots. The planks or boards 12 are in this case preferably made of wood.

The upper edges 7 of the rigid panels 3 and those 14 of the cladding panels 10 lie at approximately the same height, so that it is possible to fix a relatively broad coping 15 which straddles the said edges and the abovementioned gap 11. As illustrated in FIG. 1, the coping 15 may project somewhat inwards and/or outwards; in the latter case, better support can be provided for it by attaching corbel wedges 16 at intervals to various of the cladding panels.

Cladding made entirely of wood (planks or boards 12, the external portion 8 of the posts) may be rather expensive due to the cost of treating the wood against damp, the cost of machining the components, and heavy maintenance.

It may therefore be desirable to find a cladding of a type requiring relatively less maintenance than that necessitated by cladding in wood. For this purpose the various components may be made of a material having, at least externally, the appearance of wood; in particular, use may be made of wood composite materials (wood dust)/polymer (known in the trade as WPC—Wood Polymer Compound). These composite materials have the advantages of being relatively insensitive to moisture and of being capable of being moulded or extruded: the manufacture of the components can thus be simplified, without costly machining.

The cladding panels 10 may therefore be extruded or moulded on demand to suit the shape of the swimming pool, whether in the form of integral panels which may have a single unified face or a face that imitates a stack of planks superimposed on edge, or in the form of laths or planks stacked in the same way as described above in relation to FIG. 1 in the case of the wood panels.

Figure 3:
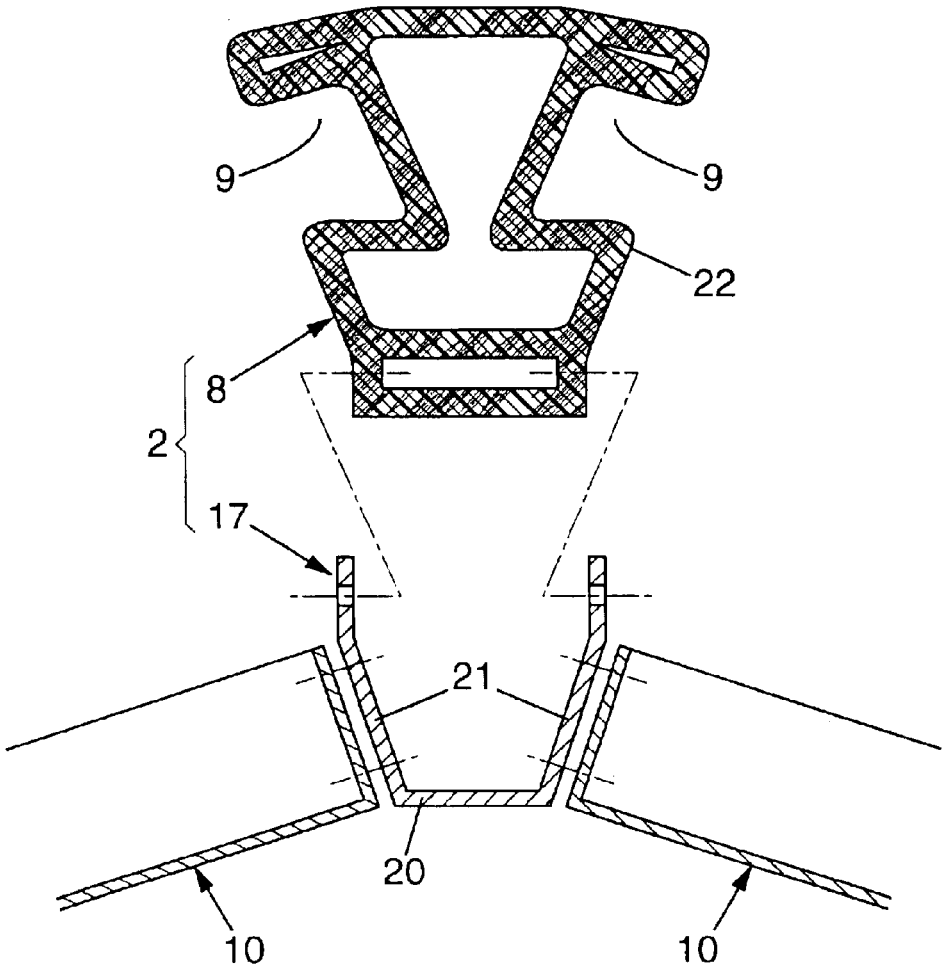
FIG. 3 is an exploded schematic view, in cross section, of an illustrative embodiment of a post in accordance with the invention.

As regards the posts 2, these can, as illustrated in FIG. 3, be constructed by assembling two sections:

a metal section 20 forming the interior portion 17 mentioned above, which may have any desired shape; for example this section may be formed by folding sheet metal so that its general form is approximately that of a U; the two flanges 21 of this section diverge like a V from each other, at an angle that is a function of the geometrical form of the swimming pool, for the attachment of the two rigid panels 10 and then end in two approximately parallel terminal parts for the attachment of the external portion 8 of the post; and a section 22, forming the abovementioned external portion 8 made of a wood/polymer composite material as mentioned above having the appearance of wood; this section 22, attachable by threaded fasteners to the metal section 20, contains the two grooves 9 referred to earlier.

It should be emphasized that the only function which the wood/polymer composite material more specifically envisaged above as a material having the appearance of wood has to fulfil that of a durable and aesthetic cladding, while the function of retaining the water, which, in contrast, requires great mechanical strength, is entirely performed by the rigid, especially metal, wall and the interior, especially metal, portion of the posts.

It will also be observed that, although the essential object of the invention is to propose means suitable for constructing above-ground swimming pools having the external appearance of a wooden swimming pool it is nonetheless possible, if the user so wishes, to decorate the external face by any means (paint, adhesive sheets, coated fabric, marine-type plywood and so on), especially if the cladding is composed of integral panels made of a wood/polymer composite material.

The absence of any functional role played by the cladding and the construction of the posts 2 in two parts open up the possibility of applying the provisions of the invention to pre-existing swimming pools that have already been installed and were not originally specifically designed to be given a cladding of wood or a material having the appearance of wood. In this case, an example would be above-ground rigid-walled swimming pools of common design having a curvilinear-round or oval-form.

Figure 2:
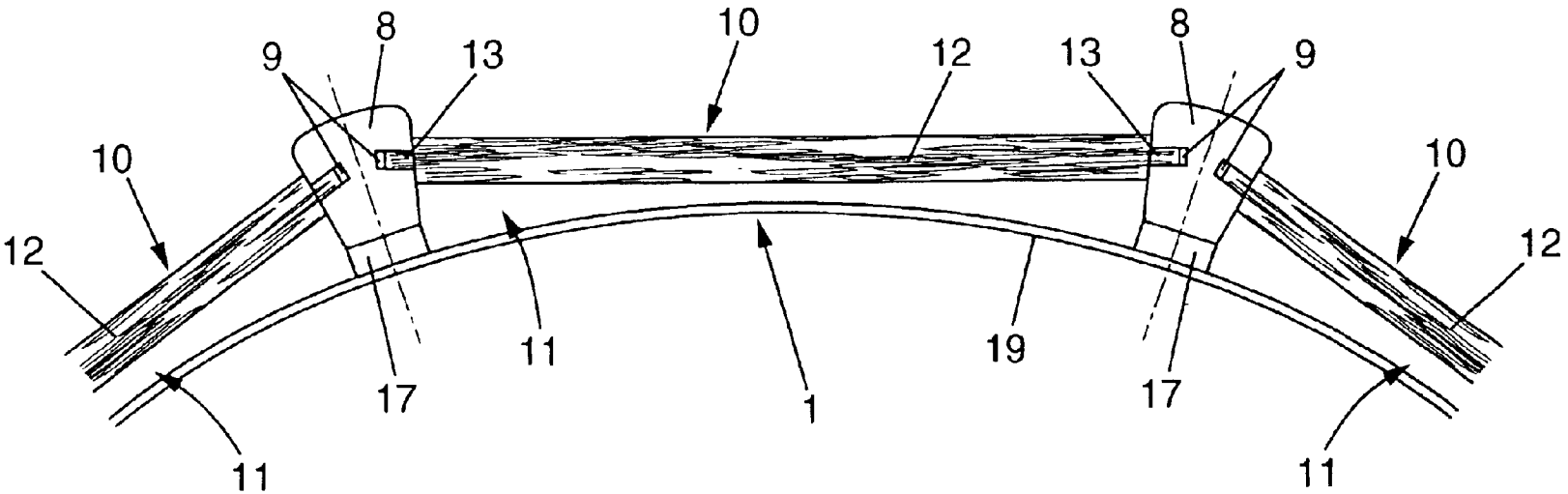
FIG. 2 is a partial schematic top view of another set-up of the above-ground swimming pool in accordance with the invention.

Such swimming pools usually have a rigid peripheral wall made of a strip of sheet metal (usually corrugated) 19 which is unwound to the desired perimeter and fastened to posts. As illustrated in FIG. 2, installing the cladding panels 10 requires fitting the original posts 17 (which may be metal or plastic) with additional parts forming the abovementioned externally projecting portions 8 and attaching them by any appropriate means (bolts, clamps, etc.).

In this case the gap 11 defined between the sheet metal 19 and each cladding panel 10 has a variable width as can be seen in FIG. 2.

It will be understood too that the provisions of the invention apply both to swimming pools that are completely above the ground, as illustrated in FIG. 1, and to pools that are partially below ground. In this case the cladding would of course only be applied to the above-ground part of the swimming pool.

What is claimed is:

1. An above-ground swimming pool with a rigid structure, comprising a rigid peripheral wall made of a rot-resistant material supported by posts and a flexible waterproof liner arranged in the space defined by the rigid wall made of rot-resistant material and attached to the upper edge of the said wall, wherein:

along their full height, the posts comprise an interior portion made of a rot-resistant material to which the abovementioned rigid wall is secured and an externally projecting portion having at least two grooves, one on either side, and cladding panels having at least externally at least the appearance of wood are slid into the opposing grooves of two consecutive posts;

the externally projecting portions of the posts being of such dimensions and the grooves being so positioned that there is a gap between the cladding panels and the rigid wall.

2. An above-ground swimming pool according to claim 1, having a polygonal general form and wherein the rigid wall is formed from rigid panels made of rot-resistant material each fixed to the respective portions made of rot-resistant material of successive posts.

3. An above-ground swimming pool according to claim 2, wherein said rigid panels made of rot-resistant material comprise lateral edges extending outwards and wherein each rigid panel is engaged between the respective interior portions of two consecutive posts with the extending edges applied to the respective posts and screwed to them, that face of the rigid panel which is towards the interior of the swimming pool being flush with the respective inward-facing faces of the posts.

4. An above-ground swimming pool according to claim 1, wherein said cladding panels are made of a composite wood/polymer material having at least externally the appearance of wood.

5. An above-ground swimming pool according to claim 1, wherein said cladding panels are made of wood.

6. An above-ground swimming pool according to claim 5, wherein each wooden cladding panel is constructed by stacking several wooden planks on edge.

7. An above-ground swimming pool according to claim 1, wherein the externally projecting portion of each post is made of wood.

8. An above-ground swimming pool according to claim 1, wherein the externally projecting portion of each post is a section made of a wood/polymer composite material.

9. An above-ground swimming pool according to claims 1 to 8, wherein the rigid peripheral wall and the interior portions of the posts made of rot-resistant material are made of metal.

10. An above-ground swimming pool according to claim 1, wherein the respective upper edges of the rigid wall and of the cladding panels are situated essentially at the same height and wherein a coping is attached to the upper edge of the cladding panels in such a way that it straddles said edges of both the rigid metal wall and the cladding panels and the gap between them.

11. An above-ground swimming pool according to claim 1, said swimming pool being partly below ground level, wherein cladding panels are arranged only around the above-ground part of the swimming pool.

* * * * *